United States Patent [19]

Schwarzkopf

[11] 4,300,038

[45] Nov. 10, 1981

[54] ELECTRIC CARTRIDGE HEATER

[75] Inventor: Eugen Schwarzkopf, Lüdenscheid, Fed. Rep. of Germany

[73] Assignee: Firma Hotset Heizpatronen und Zubehor GmbH, Fed. Rep. of Germany

[21] Appl. No.: 165,350

[22] Filed: Jul. 2, 1980

[30] Foreign Application Priority Data

Aug. 17, 1979 [DE] Fed. Rep. of Germany ..... 2933376

[51] Int. Cl.[3] ..... H05B 3/44

[52] U.S. Cl. ..... 219/544; 219/523; 219/541; 219/552; 338/238; 338/240; 27/615

[58] Field of Search ..... 219/267, 270, 523, 544, 219/548, 552; 338/238, 239, 240, 241, 242, 250, 274; 361/266; 29/611, 615; 174/71

[56] References Cited

U.S. PATENT DOCUMENTS

| | | | |
|---|---|---|---|
| 1,432,064 | 10/1922 | Hadaway, Jr. | 338/241 X |
| 3,310,769 | 3/1967 | Simmons | 338/241 |
| 3,340,382 | 9/1967 | Lennox | 219/544 |
| 3,350,544 | 10/1967 | Lennox | 219/548 |
| 3,812,580 | 5/1974 | Drugmand | 338/238 X |
| 3,890,485 | 6/1975 | Kozbelt | 219/523 |

*Primary Examiner*—Volodymyr Y. Mayewsky
*Attorney, Agent, or Firm*—Jacobs & Jacobs

[57] ABSTRACT

Elecric cartridge heater having an electric heating conductor in a metallic casing and held on a support of insulating material, each of the ends of the conductor being connected with a lead of lesser electrical resistance than the heating conductor and extending through the open end of the casing the opposite end of which is closed and the conductors being electrically insulated from the heating conductor. The insulating material, preferably magnesium oxide, fills the casing and is present between the casing and the heating conductor and being compacted by diametric reduction or compression of the casing.

2 Claims, 2 Drawing Figures

ELECTRIC CARTRIDGE HEATER

Figure 1:
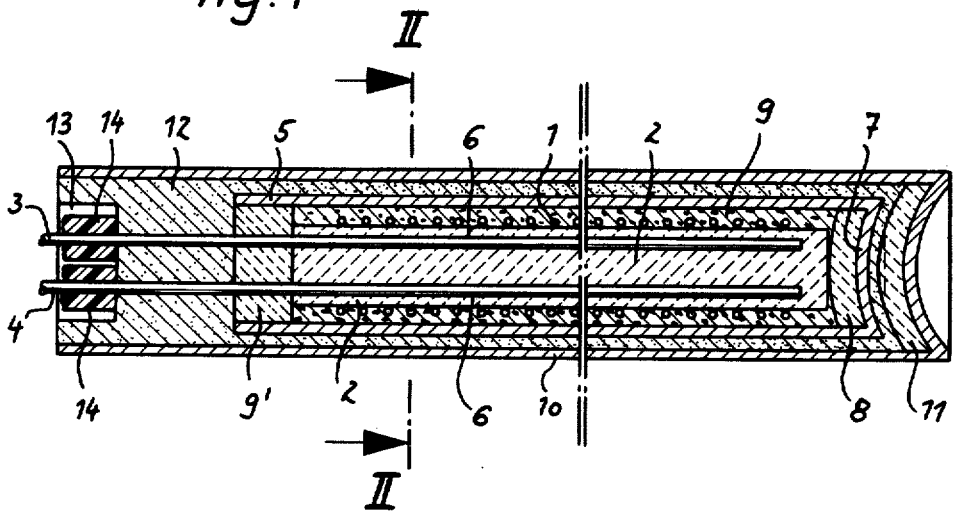

The present invention relates to an electric cartridge heater consisting of at least one electric heating conductor arranged in a metallic casing, particularly a cylindrical casing, and held on a support of insulating material, each of the ends of the conductor being connected with a lead which is of lesser electrical resistance than the heating conductor and extends through the open end of the casing, the opposite end of which is closed, and the conductors being electrically insulated from the heating conductor. The insulating material, in particular magnesium oxide, fills the casing and is present between the casing and the heating conductor, being compacted by diametric reduction or compression of the casing.

Such well-known cartridge heaters are inserted without play in a suitably dimensioned borehole of an apparatus which is to be heated in order to transmit, without substantial loss, the heat produced by the cartridge heater to the apparatus to be heated.

The insulation of the cartridge heater, which is generally adapted to be connected to a rated voltage of 220 V, is designed in this connection for a breakdown voltage of about 1.5 kV, which is sufficient in most cases.

For example, when such cartridge heaters are used in apparatus for reducing the growth of horn by the action of heat in cattle for reasons of safety a breakdown strength of 3.5 kV/cm is desired.

In the present invention, however, as in most uses, the outside dimensions of the cartridge heater are predetermined by the apparatus in which the heater is to be inserted. A higher electric breakdown strength could not heretofore be obtained in such cases by increasing the dimension of the insulation.

The object of the present invention is to make it possible to increase the breakdown strength of a cartridge heater of the above-described type without reducing the heating output and without imparting to the outside shape of the cartridge heater a larger size than heretofore.

This problem is solved in such manner that a cartridge heater of the above-described type is inserted into a second larger metallic casing similar in shape to the cartridge heater, and subsequently highly compacted insulating material, in particular granular magnesium oxide, is arranged between the two metallic casings which are coaxial to and spaced apart from each other, whereby the cartridge heater is heated to a high temperature both before and after its insertion into the second metallic casing.

By these measures it has been possible to construct cartridge heaters in accordance with the present invention so as to obtain an increase in the breakdown strength of more than 40% as compared with traditional cartridge heaters of the same external dimensions and the same heating power.

It is advantageous in this connection for the outer casing as well as the insulation arranged between the casings to extend beyond the mouth of the inner casing, closing off the outer casing, by a distance equal to about the diameter of the outer casing and for a depression to be formed in the end of the insulating material which is spaced from the metallic casings and arranged in the free-end side of the insulation.

In this way, longer surface leakage paths and thus also greater tracking resistance are obtained without additional expense than with the known cartridge heaters in which the mouth of the casing is closed by a flat insulating plug on the end side.

In addition, one advantageous further development of the object described above is characterized by the fact that the leads are insulated by means of silicone tubes or the like which extend up into the end-side depression of the insulation and are applied to the latter at the end side.

Figure 2:
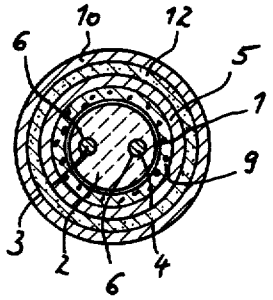

A preferred illustrative embodiment of the invention is shown on a scale of 2:1 in the drawing, in which:

FIG. 1 is a longitudinal section through an electric cartridge heater according to the present invention, and FIG. 2 is a transverse section along the line II—II of FIG. 1.

In the present cartridge heater, an electric heating conductor 1 is wound helically around a heating conductor support 2 of insulating material, particularly ceramic material, which is of cylindrical cross-section.

The ends of the heating conductor support 2 are connected firmly with leads 3 and 4 whose cross-section is greater than that of the heating conductor 1 and which leads consist of a material of lower electrical resistance than the heating conductor 1.

The support 2 which holds the heating conductor 1 is inserted, coaxially aligned, into a cylindrical casing 5 of steel, particularly stainless steel, which is electrically insulated from the heating conductor.

Previously, the leads 3, 4 have been extended outwards, through channels 6 in the support 2 so as to pass through the heating-conductor support 2. The casing 5 is closed off at one end by an end closure 7 of steel which may be concave as shown in FIG. 1.

Between the latter and the facing end side of the heating conductor support 2 a disk 8 of insulating material is arranged.

Furthermore, the casing 5 is filled with insulating material 9, particularly a magnesium-oxide granulate. The mouth of the casing 5 is closed by a plug of insulating material 9' through which the leads 3, 4 pass.

Thereupon, the casing 5 has been reduced in diameter over its entire length, all insulating material present within the casing 5 having been highly compacted. This unit is then heated at about 900° C. in order to dry out the insulating material and was then inserted, coaxially aligned, into a second larger and longer casing 10 which is similar in shape to the casing 5. The bottom 7 of the casing 5 rests in this connection against a disk 11 of insulating material inserted into the casing 10.

The casing 10 is not only larger in inside diameter than the outside diameter of the casing 5 but is also longer than the latter so that the casing 10 extends beyond the casing 5 on its mouth side.

The second casing 10 is also filled with insulating material 12, preferably magnesium oxide, which has been highly compressed by a subsequent reduction of the diameter of the casing 10, the insulating materials 12 having also been applied force-locked and tightly sealed to the leads 3 and 4.

In order to improve the tracking resistance, a depression 13 which is smaller in diameter than the casing 10 is formed in the free-end side of the insulating material 12 which has been highly compacted and then also dried out by heating at 900° C.

The leads 3 and 4 are covered, outside the cartridge heater, with silicone tubes 14 which extend into the recess 13 and have their ends applied to the insulation 12.

For instance, with various cartridge heaters developed in accordance with the invention each of which had an outside diameter of 16 mm and a length of 80 mm and were designed for a rated voltage of 220 V and a power of 315 watts, a breakdown voltage 3800 to 4000 V was measured on the casing 10 while a breakdown voltage of 2000 and 2500 V was measured on the inner casing 5 having an outside diameter of about 11.5 mm. The casings in each case had a wall thickness of about 1 mm.

Another cartridge heater having the same dimensions as above but designed for a power of 240 W had a breakdown voltage of 2200 V as measured on the inner casing 5 and a breakdown voltage of 3900 V on the outer casing, while with known cartridge heaters of the same outside dimensions a breakdown voltage of about 2500 V was found.

I claim:

1. Electric cartridge heater consisting of at least one electrical heating conductor arranged in a metallic and particularly cylindrical casing and held on a support of insulating material, the ends of said heating conductor being each connected to a lead, which leads are of lower electrical resistance than the heating conductor and are extended to the open end of the casing which is closed at one end and electrically insulated from the heating conductor where said leads emerge, the insulating material present between the casing and the heating conductor being compacted by reduction of the casing, the said cartridge heater being inserted into a second larger matallic casing which is similar in shape to the cartridge heater, and highly compacted insulating material being arranged between the two metallic casings which are arranged coaxially to and spaced apart from each other, and the cartridge heater having been subjected to high temperature both before and after its insertion into the second metallic casing, the outer casing and the insulation being arranged between the casings and extending beyond the mouth of the inner casing closing off the outer casing by a distance about equal to the diameter of the outer casing, and a depression arranged in spaced relationship from the metallic casings in the free-end side of the insulation.

2. An electric cartridge heater according to claim 1, wherein the leads are insulated by means of silicone tubes or the like which extend up into the end-side depression of the insulation.

* * * * *